US005944029A

United States Patent [19]

Brenner

[11] Patent Number: 5,944,029

[45] Date of Patent: Aug. 31, 1999

[54] HAIR CURLING DEVICE

[76] Inventor: Patricia I. Brenner, 15585 High Knoll Rd., Encino, Calif. 91436

[21] Appl. No.: 09/189,610

[22] Filed: Nov. 10, 1998

Related U.S. Application Data

[63] Continuation-in-part of application No. 08/982,812, Dec. 2, 1997, abandoned.

[51] Int. Cl.[6] ..... A45D 2/20

[52] U.S. Cl. ..... 132/247; 132/210; 132/222; 132/203; 132/223

[58] Field of Search ..... 132/210, 222, 132/247, 253, 245, 212, 265, 248, 250, 223, 273

[56] References Cited

U.S. PATENT DOCUMENTS

| | | | |
|---|---|---|---|
| 2,407,393 | 9/1946 | Behr | 132/273 |
| 2,484,050 | 10/1949 | Rivard | 132/247 |
| 2,700,977 | 2/1955 | Neerup | 132/273 |
| 3,232,300 | 2/1966 | Fisher | 132/245 |
| 3,590,829 | 7/1971 | Parisi | 132/248 |
| 4,584,462 | 4/1986 | Morrisin | 219/222 |
| 5,000,200 | 3/1991 | Roberts | 132/245 |
| 5,662,128 | 9/1997 | Habibi | 132/210 |

*Primary Examiner*—Gene Mancene
*Assistant Examiner*—Pedro Philogene
*Attorney, Agent, or Firm*—Jack C. Munro

[57] ABSTRACT

A hair curling device which has an elongated flexible member in the form of a strip which has a self coiling capability from an at-rest storage configuration, and when initially moved from a longitudinally straight configuration will automatically form a coiled configuration of a substantially circular shape. An attachment is mounted on the strip to connect the outer side of the strip with the overlapped inner side of the strip when in the coiled configuration and maintain the substantially circular shape. Depending on the point of connection of the attachment, coiled configuration can comprise various different diameters.

9 Claims, 4 Drawing Sheets

HAIR CURLING DEVICE

REFERENCE TO PRIOR APPLICATION

This patent application is a continuation-in-part of U.S. patent application Ser. No. 08/982,812, filed Dec. 2, 1997, now abandoned, entitled HAIR CURLING DEVICE, by the present inventor.

BACKGROUND OF THE INVENTION

1) Field of the Invention

This invention relates to a hair curling device and more particularly to hair curlers/rollers used to style hair.

2) Description of Prior Art

Hair curlers are well known in the prior art and are available in many different diameters to allow a user to produce different sizes and styles of curls in a user's hair. Hair curlers are for changing the shape of hair prior to final style. Thus, it has been necessary for a user to own multiple sets of curlers with different diameters if variations in curl size and style are desired. However, there are practical disadvantages to owning multiple sets of conventional hair curlers. Such disadvantages include the added cost of additional sets and the storage of the additional sets.

Conventional hair curlers maintain a cylindrical shape even when not in use. A typical individual curler takes up two to four inches in diameter plus about one to four inches in width. With a set of curlers having up to a dozen or more individual curlers, it is clear that additional sets of curlers of different diameters would occupy a great deal of space and thus present a storage problem for the user. This can be particularly troublesome while traveling, when storage space is precious.

To avoid having additional sets, there is a need for a hair curling device which can be adjusted to form hair curlers of different diameters. Moreover, there is a need for a hair curling device which, when not in use, can be stacked thereby taking up less space than conventional curlers.

SUMMARY OF THE INVENTION

One of the primary objectives of the present invention is a hair curling device that is to be adjusted in diameter to form different sizes of hair curlers.

Another objective of the present invention is, when not in use, the hair curling device can be straightened so as to lie substantially flat permitting stacking for easier storage.

Another objective of the present invention is to construct a hair curling device which can be manufactured inexpensively thereby sold to the consumer at an inexpensive price.

The subject matter of this invention comprises an elongated, rigid, flexible strip with an attaching arrangement to fix the strip in a coiled configuration. One form of attaching arrangement comprises a pad of a mass of tiny hooks mounted on the outer side of the strip and a pad of a mass of tiny eyelets mounted on the inner side of the strip. The strip can be located either in a storage configuration or a usage configuration. With the hair curling device located in either the storage configuration or the usage configuration, the hair curling device is at-rest. Upon immediate movement from the storage configuration toward the usage configuration, a spring bias, built into the strip, will automatically cause the strip to self curl or coil and assume a substantially circular shape, the coiled configuration, with diameter selection being achieved by the attachment. Usage is to occur with the strip in the coiled configuration. A second form of attaching arrangement comprises a hook which is fixed to the strip and connects with a hole formed in the strip when in the coiled configuration. There can be a plurality of holes, spaced apart, with each hole to produce a different diameter when in the coiled configuration. When using the hook form of attachment, there is no need for the pads of hooks and eyelets.

DESCRIPTION OF THE PREFERRED EMBODIMENT

Figure 1:
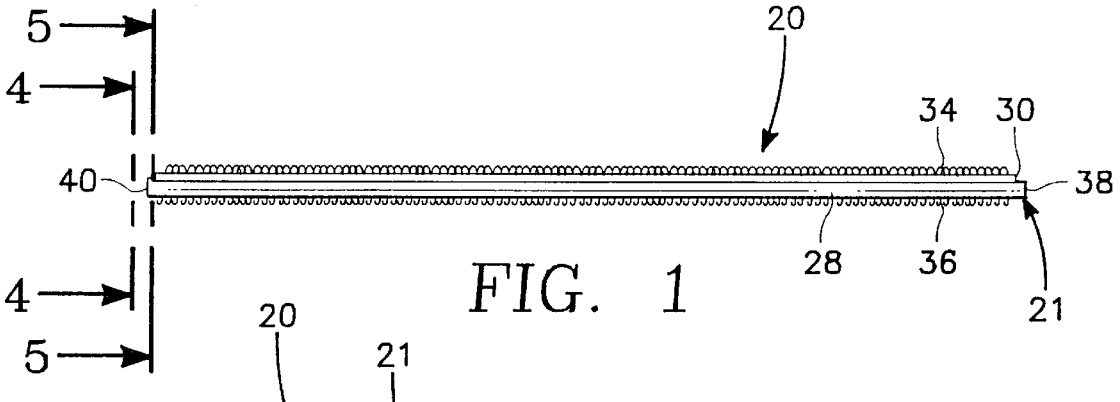
FIG. 1 is an enlarged side elevational view of the hair curling device of the present invention which uses eyelet and hook pads showing the hair curling device in a longitudinally straight position.

Referring particularly to the drawings, there is shown in FIG. 1 the hair curling device 20 of this invention. The hair curling device will be capable of being located in a storage configuration, such as longitudinally straight, of a length of between six to twelve inches with a preferred length being approximately ten inches. Although longitudinally straight is the preferred storage configuration, it is possible that storage could occur in other than a longitudinally straight configuration such as being coiled tightly. The width of the hair curling device 20 would generally be between one to four inches with about two and one half inches being preferred.

The main structural component of the hair curling device 20 is a base 21. The base 21 is basically in strip form and includes a main structural member 22 which will be normally constructed of a metal such as steel or aluminum. The main structural member 22 is referred to as a strip in the claims located at the end of this specification. However, it is considered to be within the scope of this invention that the main structural member 22 could be constructed of a material other than a metal such as a plastic. The thickness of the main structural member 22 would generally be no more than a few thousandths of an inch.

Figure 2:
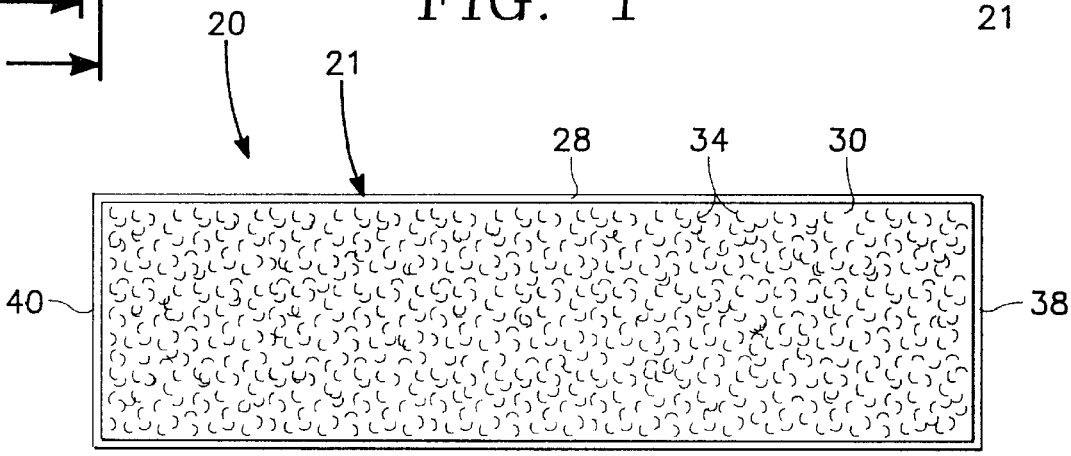
FIG. 2 is a top plan elevational view of the hair curling device shown in FIG. 1.
Figure 3:
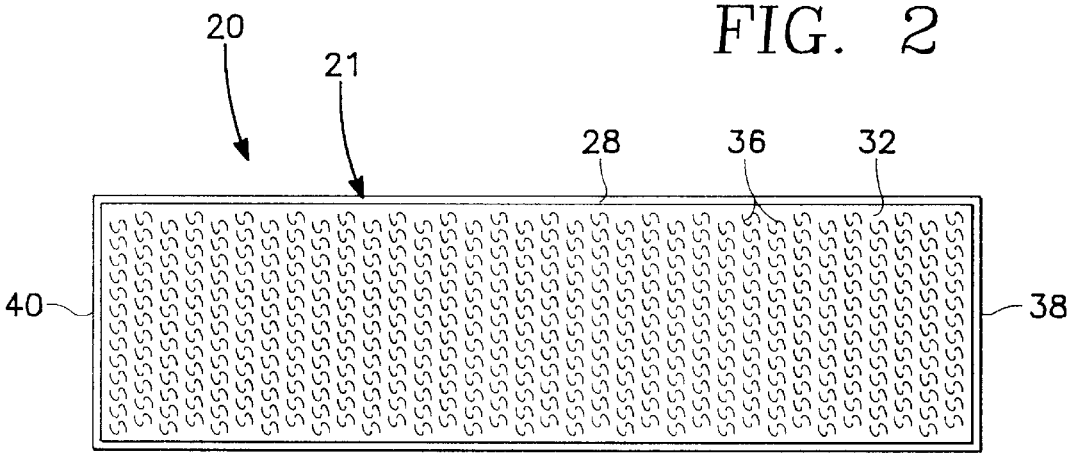
FIG. 3 is a bottom plan elevational view of the hair curling device shown in FIG. 1.
Figure 4:
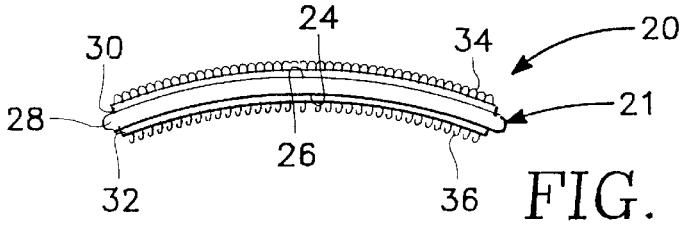
FIG. 4 is an enlarged left end view of the hair curling device shown in FIG. 1 taken along line 4—4 of FIG. 1 clearly showing the bowed configuration.
Figure 5:
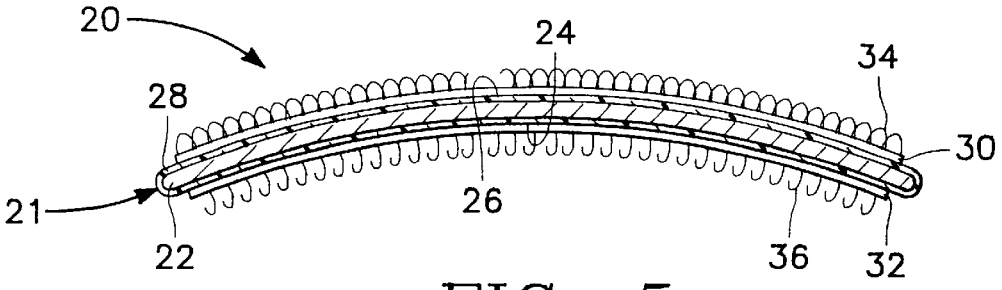
FIG. 5 is a transverse cross-sectional view through the hair curling device of this invention taken along line 5—5 of FIG. 1 again clearly showing the bowed configuration which is only present when the hair curling device is longitudinally straight.
Figure 6:
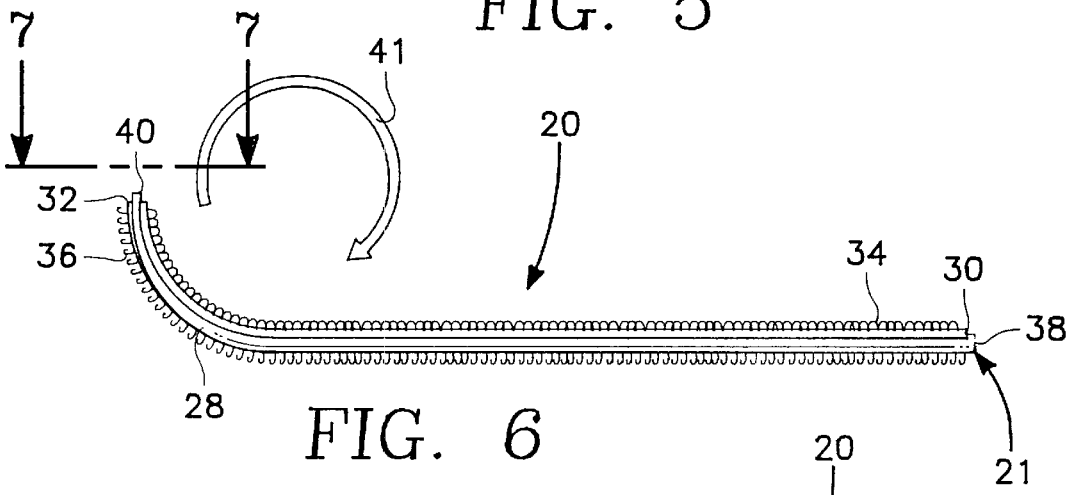
FIG. 6 is a side elevational view similar to FIG. 1 but showing the hair curling device in the stage of beginning to curl toward the coiled position which is the position of usage.
Figure 7:
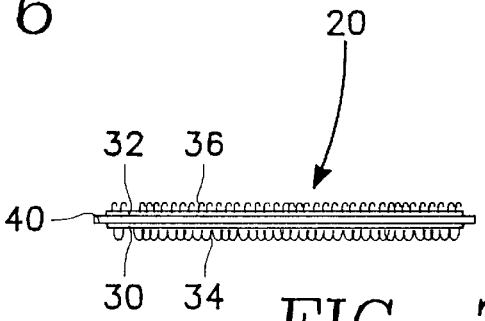
FIG. 7 is an end view of the hair curling device taken along line 7—7 of FIG. 6 with the device no longer bowed but transversely flat.
Figure 9:
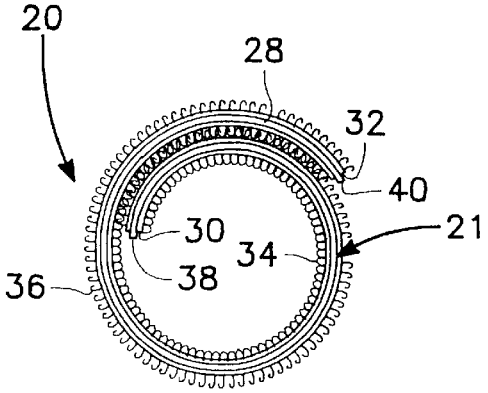
FIG. 9 is a side elevational view of the hair curling device of this invention showing the hair curling device in a small diameter usage position.

It is necessary if the hair curling device is going to store longitudinally straight that the main structural member 22 be constructed so that in transverse cross-section, the main structural member 22 is bowed and has a concave inner surface 24 and a convex outer surface 26 extending the entire length of the strip. However, this concave inner surface 24 and the convex outer surface 26 occurs only when the main structural member 22 is in the longitudinally straight configuration shown in FIGS. 1–3. It is this bowed configuration that causes the main structural member 22 to remain in the longitudinally straight configuration and be at-rest. The constant tension to locate the main structural member 22 in a coiled configuration is overcome by the bowed configuration. However, once one end of the main structural member 22 is started to move out of the longitudinally straight configuration and be coiled, this bowed configuration is immediately lost (FIGS. 6 and 7) and the main structural member 22 curls, as depicted by arrow 41 of FIG. 6 to a coiled configuration substantially as shown in FIG. 9 of the drawings. When the hair curling device is in the coiled configuration, it is transversely flat as is shown in FIG. 7.

It would normally be desirable to coat the entire exterior surface of the main structural member 22 by means of a coating 28. A typical coating would be a thin plastic covering. It is the purpose of the coating 28 to cover any sharp edges of the main structural member 22 to provide protection to prevent injury to the user.

Applied onto the coated convex surface 26, substantially the entire length of the base 21, is a first attaching pad 30. A second attaching pad 32 is fixedly secured onto the coated convex surface 26. The first attaching pad 30 is constructed to include a mass of tiny eyelets 34 with the second attaching pad 32 including a mass of tiny hooks 36. The attaching pads 30 and 32 are deemed to be conventional, and basically are constructed to resemble fabric. This type of fastener arrangement is commonly sold under the trademarks of Velcro, Rip and Grip, Scotchmate and Maztex. Although this pad fastener arrangement is preferred, it is considered that other forms of fasteners could be used such as snaps.

Figure 8:
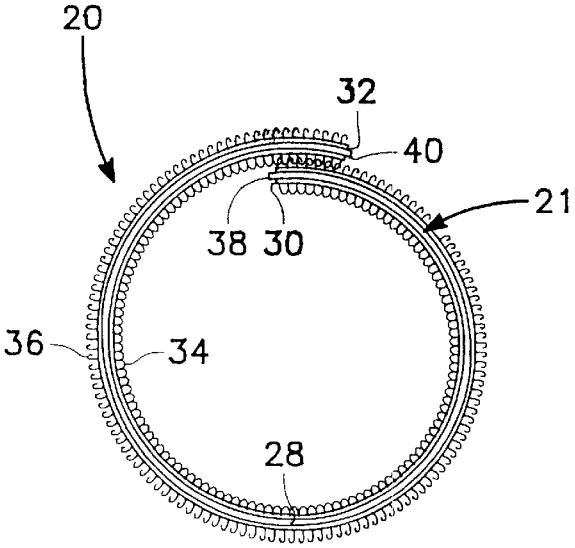
FIG. 8 is a side elevational view of the hair curling device of this invention showing the hair curling device in a large diameter usage position.

Attachment pads 30 and 32 are normally secured by an adhesive onto their respective surfaces 26 and 24. It is to be understood that once a bending of the base 21 is initiated, as is shown in FIG. 6, the hair curling device 20 will automatically self coil to the position shown in FIG. 8. To have the hair curling device 20 be in the position as shown in FIG. 8, it is necessary to manually uncurl the hair curling device 20 until ends 38 and 40 of the base 21 are located directly adjacent each other. At that particular time, a portion of the attachment pad 32 and its hooks 36 engage with eyelets 34 of that are located directly adjacent the end 40. This will result in the hair curling device 20 assuming a substantially circular shape as shown in FIG. 8. The position shown in FIG. 8 is for producing large diameter curls in the hair while the position shown in FIG. 9 is for the purpose of producing smaller diameter curls within the hair.

The exact size of the hair curling device 20 is determined by the minimum and maximum size of curlers that are to be formed from the hair curling device 20. For example, a longer hair curling device 20 will have a larger maximum hair curler diameter but may also have a larger minimum diameter. The width of the hair curling device 20 will aid in determining the type of curls formed from the device. Big, wide curls will be produced by a four inch wide hair curling device 20 with big, narrow curls being produced by a one inch wide hair curling device 20. The dimensions previously mentioned are only for illustrative purposes and are not intended to limit the scope of this invention.

Figure 10:
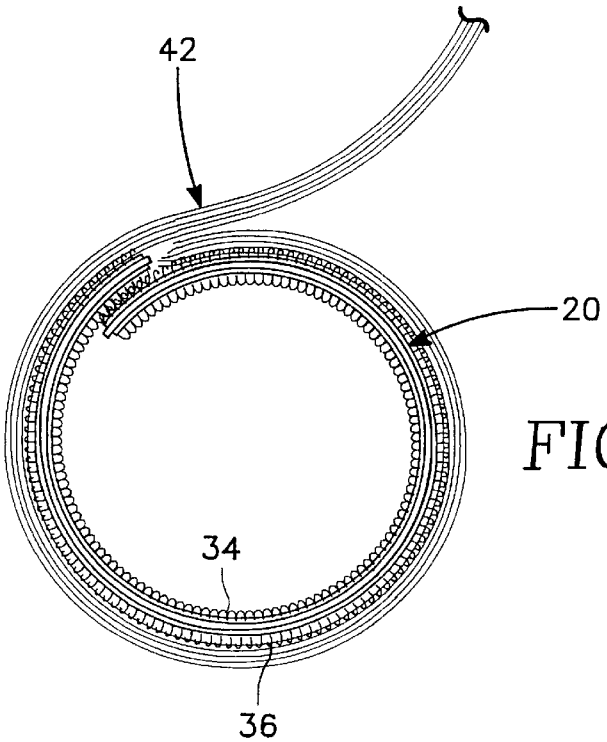
FIG. 10 is a view depicting usage of the hair curling device of this invention after it is formed into a circle showing a strand of hair wound about the hair curling device.

Referring particularly to FIG. 10, there is shown the fixed size of hair curler that is shown in FIGS. 8 and 9 being mounted within hair and with a strand 42 of the hair being wound around the periphery of the hair curling device 20. The strand 42 of the hair will tend to remain on the hair curling device 20 since the hair will imbed slightly within the hooks 36. If a different type of fastener is used which does not include hooks 36, there might not be used any structure to adhere to the hair.

Figure 11:
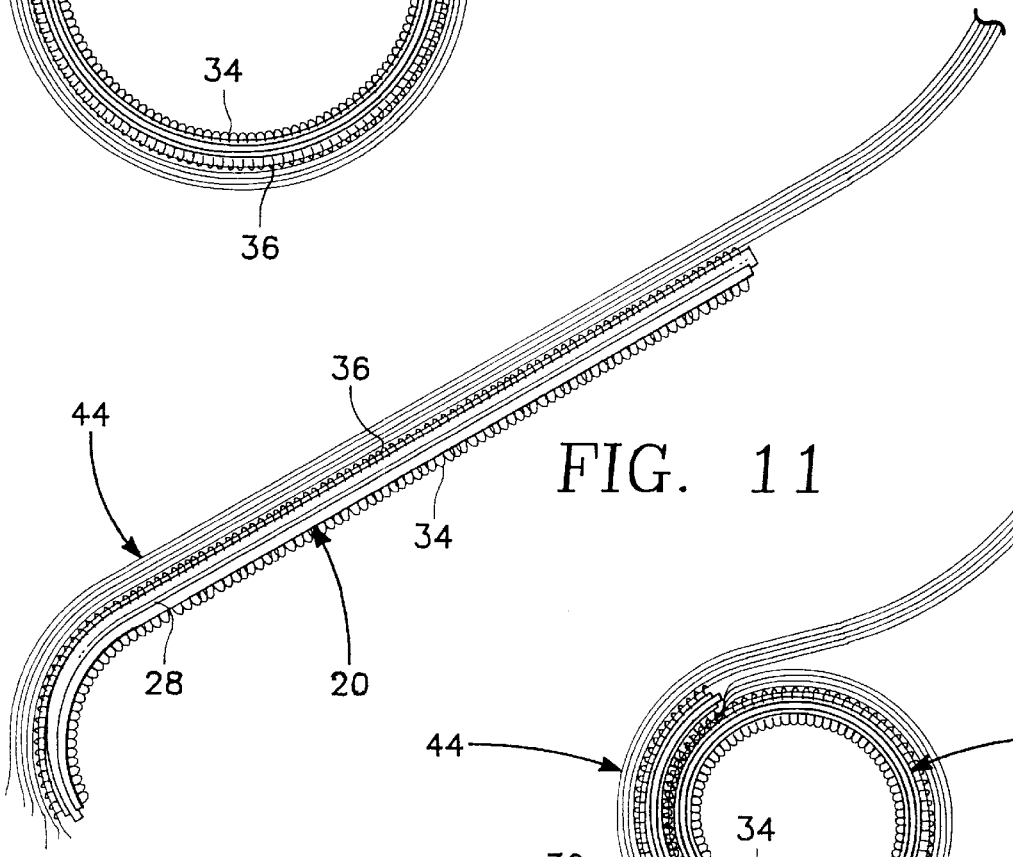
FIG. 11 is a view depicting another form of usage of the hair curling device of this invention showing the strand of hair placed in contact with the hair curling device with coiling of the hair curling device being initiated.
Figure 12:
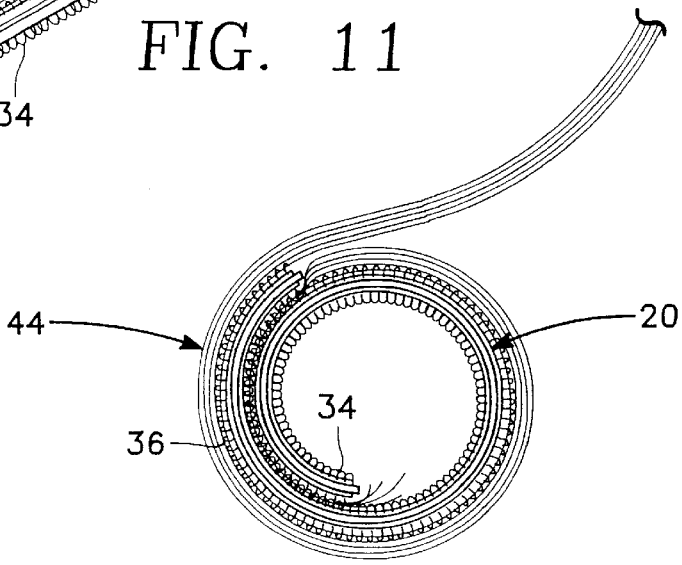
FIG. 12 is a view of the hair curling device of FIG. 10 with the strand of hair completely wound on the device.

Referring particularly to FIG. 11, there is shown a different way of using the hair curling device 20 where the strand 44 of hair is placed in contact with the hair curling device 20 when it is in the straight configuration. The hair curling device 20 is then permitted to go into the self coiling procedure which will result in the strand 44 being wound up within the hair curling device 20 as is clearly shown in FIG. 12. This usage technique of FIGS. 11 and 12 is different from that of FIG. 10 in that the hair curling device 20 is coiled when in contact with the hair where in FIG. 10, the coiling of the hair curling device 20 is accomplished prior to its initial contact with the strand of hair 42.

Figure 13:
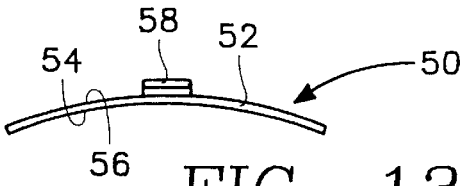
FIG. 13 is an edge view of a modified form of hair curling device which uses a single hook as the form of attachment.
Figure 15:
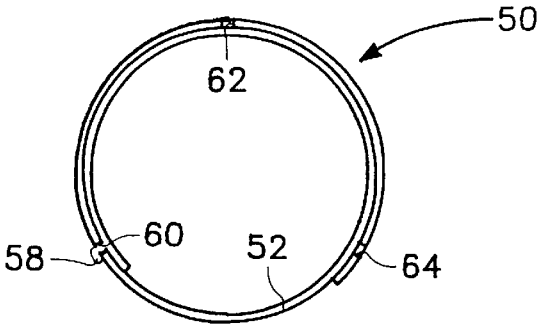
FIG. 15 is an end view of the modified form of hair curling device showing the device in the smallest coiled configuration.
Figure 14:
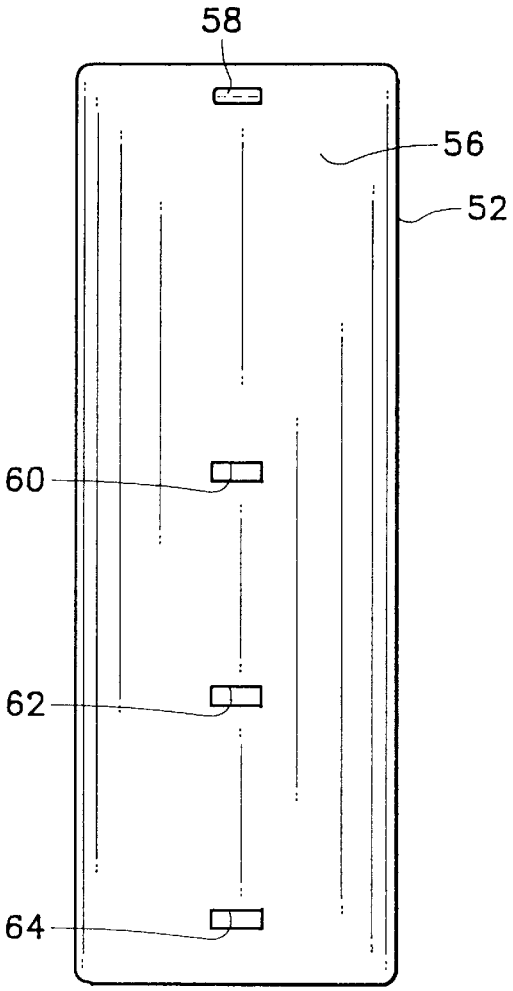
FIG. 14 is a top plan elevational view of the modified form of hair curling device of FIG. 13.
Figure 16:
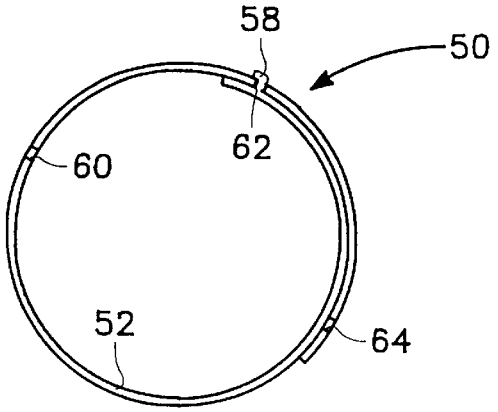
FIG. 16 is a view similar to FIG. 15 showing the hair curling device in a larger coiled configuration.

Referring particularly to FIGS. 13–16, there is shown a modified form 50 of the hair curling device of this invention. The hair curling device 50 is constructed of a main structural member 52 which will normally be of a metallic material. The main structural member 52 is constructed to include a tension force that tends to locate the main structural member 52 in a coiled configuration as shown in FIGS. 14–16. However, the main structural member 52 can be located in a straight configuration as shown in FIG. 13, and when in the straight configuration as shown in FIG. 13, the main structural member 52 will deform assuming a slightly bowed configuration within the straightened configuration as shown in FIG. 14.

The main structural member 52, when in a straight configuration as shown in FIGS. 13 and 14, will be bowed, that is having a concave inner surface 54 and a convex outer surface 56. This deformation of the hair curling device 50 by this bowing will be sufficient to restrain the device against the inherent tendencies for the main structural member 52 to assume a coiled configuration. In other words, this bowing, as previously discussed in relation to the hair curling device 20, holds the main structural member 52 in the straight configuration preventing the main structural member 52 from becoming coiled. Mounted on the convex, exterior surface 56, and centrally disposed and laterally centrally located, is a hook member 58. Formed within the main structural member 52 are three in number of holes 60, 62 and 64. The holes 60, 62 and 64 are spaced apart and are longitudinally in line with the hook member 58 in relation to the main structural member 52. This longitudinal alignment position can be readily observed within FIG. 14.

Figure 17:
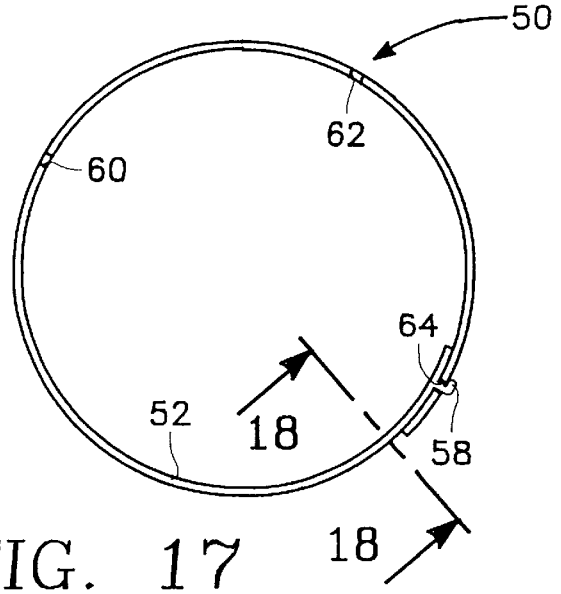
FIG. 17 is a view similar to FIG. 15 showing the hair curling device in the largest coiled configuration.
Figure 18:
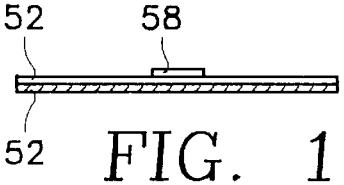
FIG. 18 is an end view, partly in cross-section, of the hair curling device in the coiled position taken along line 18—18 of FIG. 17.

Once the main structural member 52 is physically moved from the bowed configuration, the main structural member 52 will automatically move to the coiled position as shown in FIGS. 15–17. It can be readily observed that the main structural member 52 is no longer bowed, as is shown in FIG. 18, but is now transversely flat. With the hook member 58 located within the hole 60, the hair curling device 50 is in the smallest diameter position as shown in FIG. 15. With the hook member 58 within the hole 62, the hair curling device 50 assumes a diameter greater than that of FIG. 15 but smaller than that of FIG. 17. When the hook member 58 engages with the hole 64 as shown in FIG. 17, the hair curling device 50 of this invention is in its largest diameter position.

In essence, the hook member 58 and the holes 60, 62 and 64 present a second form of attachment for positioning of the hair curling device 50 into different diameter positions in a manner that was previously accomplished by the attaching pads 30 and 32.

What is claimed is:

1. A hair curling device comprising:

an elongated, thin, flexible strip constructed of a rigid material having an outer surface and an inner surface, said strip being positionable in a storage position and a usage position, said usage position locates said strip substantially circular, both said storage position and said usage position being at-rest, said strip being movable from said storage position to said usage position by manually initiating movement of said strip toward said usage position with self coiling occurring after said initiating movement, with said strip in said storage position said strip in transverse cross-section being bowed, with said strip in said usage position said strip in transverse cross-section being flat, said strip being subjected to a constant tension when flat tending to cause said strip to assume a coiled configuration with said constant tension being overcome by said strip being bowed; and whereby the constant tension is produced within said strip by the strip being bowed producing a concave inner surface and a convex outer surface extending the entire length of the strip, this concave inner surface and concave outer surface occurs only when the strip is in said storage position, said bowed configuration causes said strip to remain longitudinally straight which constitutes said storage position.

2. The hair curling device as defined in claim 1 wherein:

said storage position being straight.

3. The hair curling device as defined in claim 1 wherein:

said strip being substantially entirely covered with a coating, said coating comprising a plastic.

4. The hair curling device as defined in claim 1 wherein:

attaching means mounted on said strip to fixedly position said strip in said usage position where said usage position can assume positions of different diameters permitting said hair curling device to be used to produce different sizes of hair curls.

5. The hair curling device as defined in claim 4 wherein:

with said strip in said storage position said attaching means being disconnected.

6. The hair curling device as defined in claim 5 wherein:

said attaching means comprises a first pad having a plurality of loops on said inner side of said strip and a second pad having a plurality of hooks on said outer side of said strip, when said strip is located in said usage position and said inner side overlaps with said outer side, said hooks will engage with said loops fixing said strip in said usage position which is a coiled configuration.

7. The hair curling device as defined in claim 1 wherein:

said attaching means comprises a first pad having a plurality of loops on said inner side of said strip and a second pad having a plurality of hooks on said outer side of said strip, when said strip is located in said usage position said inner side overlaps with said outer side, said hooks will engage with said loops fixing said strip in said usage position which is a coiled configuration.

8. The hair curling device as defined in claim 4 wherein:

said attaching means comprising a hook member mounted on said strip which engages with a first hole formed within said strip, with said hook member engaging with said first hole said strip is in a first diametrical size.

9. The hair curling device as defined in claim 8 wherein:

there being formed within said strip a said second hole, said second hole being spaced from said first hole, with said hook member connecting with said second hole said strip being located at a second diametrical size which is different from said first diametrical size.

* * * * *